US009365371B2

(12) United States Patent
Tahara

(10) Patent No.: US 9,365,371 B2
(45) Date of Patent: Jun. 14, 2016

(54) SHEET WIDTH ALIGNING DEVICE AND SHEET FEEDING DEVICE

(71) Applicant: KYOCERA Document Solutions Inc., Osaka-shi, Osaka (JP)

(72) Inventor: Mitsuhiro Tahara, Osaka (JP)

(73) Assignee: KYOCERA DOCUMENT SOLUTIONS INC., Osaka-shi, Osaka (JP)

( * ) Notice: Subject to any disclaimer, the term of this patent is extended or adjusted under 35 U.S.C. 154(b) by 0 days.

(21) Appl. No.: 14/862,199

(22) Filed: Sep. 23, 2015

(65) Prior Publication Data

US 2016/0090257 A1 Mar. 31, 2016

(30) Foreign Application Priority Data

Sep. 26, 2014 (JP) ..... 2014-197439

(51) Int. Cl.

| | |
|---|---|
| ***B65H 1/00*** | (2006.01) |
| ***B65H 9/10*** | (2006.01) |
| ***B65H 11/00*** | (2006.01) |
| ***B65H 9/04*** | (2006.01) |
| ***B65H 9/06*** | (2006.01) |

(52) U.S. Cl.

CPC .. *B65H 1/00* (2013.01); *B65H 9/04* (2013.01); *B65H 9/06* (2013.01); *B65H 9/101* (2013.01); *B65H 11/00* (2013.01); *B65H 2403/411* (2013.01); *B65H 2405/114* (2013.01); *B65H 2405/1116* (2013.01); *B65H 2405/1117* (2013.01); *B65H 2405/1142* (2013.01); *B65H 2405/11162* (2013.01); *B65H 2405/11425* (2013.01); *B65H 2511/10* (2013.01); *B65H 2511/12* (2013.01)

(58) Field of Classification Search

CPC ..... B65H 1/00; B65H 9/04; B65H 9/06; B65H 9/101; B65H 11/00; B65H 2403/411; B65H 2405/1116; B65H 2405/11162; B65H 2405/1117; B65H 2405/1142; B65H 2405/11425; B65H 2405/114; B65H 2511/10; B65H 2511/12

USPC ..... 271/171, 240, 241

See application file for complete search history.

(56) References Cited

U.S. PATENT DOCUMENTS

2011/0169215 A1* 7/2011 Oh ..... B65H 1/266 271/227

(Continued)

FOREIGN PATENT DOCUMENTS

JP 2006240857 A 9/2006

*Primary Examiner* — David H Bollinger

(57) ABSTRACT

A sheet width aligning device includes an elevator tray, a pair of guides, and a pinion. The pinion is rotatably supported by inserting a shaft portion into a shaft hole formed in the pinion. The shaft portion projects from the elevator tray. The sheet width aligning device is configured to move the pair of guides so as to increase or decrease the distance between the guides in operative association with the pair of racks meshed with the pinion. The sheet width aligning device includes a pressing mechanism. The pressing mechanism is provided on the back face side of the elevator tray and includes an abutment member that abuts against the pinion. The pressing mechanism separates the abutment member away from the pinion at the lower position, while abutting the abutment member against the pinion to press the pinion at the upper position.

6 Claims, 11 Drawing Sheets

(56) References Cited

U.S. PATENT DOCUMENTS

2011/0285075 A1* 11/2011 Nakamura ..... B65H 1/266
271/109
2011/0309570 A1* 12/2011 Uchino ..... B65H 3/44
271/253
2012/0080839 A1* 4/2012 Akimatsu ..... B65H 1/04
271/253
2014/0291919 A1* 10/2014 Arimura ..... B65H 1/04
271/171
2015/0054218 A1* 2/2015 Ishida ..... B65H 9/101
271/250
2015/0102552 A1* 4/2015 Doshida ..... B65H 1/04
271/171

* cited by examiner

SHEET WIDTH ALIGNING DEVICE AND SHEET FEEDING DEVICE

INCORPORATION BY REFERENCE

The disclosure of Japanese Patent Application No. 2014-197439 filed on Sep. 26, 2014 including the specification, drawings and abstract is incorporated herein by reference in its entirety.

BACKGROUND

The present disclosure relates to a sheet width aligning device and a sheet feeding device.

Image processing apparatuses, typified by digital multi-function peripherals, are provided with a sheet feeding device that feeds sheets of paper. The sheet feeding device includes a manual feed tray that accommodates various types of media suitable to be manually fed. The sheets are aligned with each other in the width direction and the aligned sheets are placed properly in the manual feed tray. In short, the properly aligned sheets along the width are loaded.

There are some well-known techniques of aligning sheets of paper along the width. A typical sheet width aligning device includes a pair of width aligning cursors each having cylindrical driven rotors that rotate horizontally and springs that serve as elastic members. To align the sheets along the width, the springs bias the driven rotors so as to separate the driven rotors away from an inner side surface of the width aligning cursors. According to the typical sheet width aligning device, the driven rotors biased in the direction in which the driven rotors separate away from the inner side surface produce bouncing motion that absorbs the displacement of the sheets in the width direction, thereby reliably aligning the sheets along the width.

SUMMARY

In one aspect of the present disclosure, a sheet width aligning device includes an elevator tray, a pair of guides, a pair of racks, and a pinion. The elevator tray can accommodate sheets of paper thereon and can move up and down between a lower position where the sheets are loaded and an upper position where the sheets are fed. The pair of guides are provided on the elevator tray and capable of moving in the width direction of the sheets. The width direction intersects a feed direction in which the sheets are fed. The pair of guides abut against sheet edges extending along the feed direction on the elevator tray to limit the movement of the sheets in the width direction. The pair of racks are coupled with the pair of guides, respectively. The pinion is rotatably supported by inserting a shaft portion into a shaft hole formed in the pinion. The shaft portion projects from the elevator tray. The sheet width aligning device is configured to move the pair of guides so as to increase or decrease the distance therebetween in operative association with the pair of racks meshed with the pinion. The sheet width aligning device includes a pressing mechanism. The pressing mechanism is provided on the back face side of the elevator tray and includes an abutment member that abuts against the pinion. The pressing mechanism separates the abutment member away from the pinion when the elevator tray is in the lower position, while abutting the abutment member against the pinion to press the pinion when the elevator tray is in the upper position.

In another aspect of the present disclosure, a sheet feeding device includes a sheet feeding mechanism that feeds sheets of paper and a sheet width aligning device that aligns the sheets in the width direction. The sheet width aligning device included in the sheet feeding device is the one described above.

DETAILED DESCRIPTION

Figure 1:
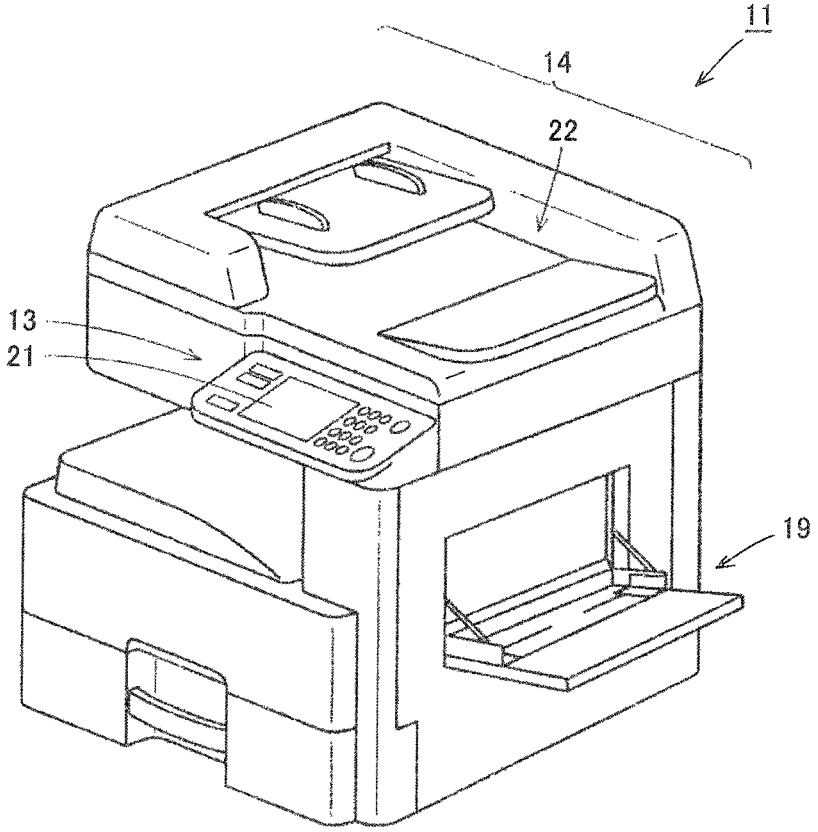
FIG. 1 is a schematic perspective view showing the appearance of a digital multi-function peripheral equipped with a sheet feeding device including a sheet width aligning device according to an embodiment of the present disclosure.
Figure 2:
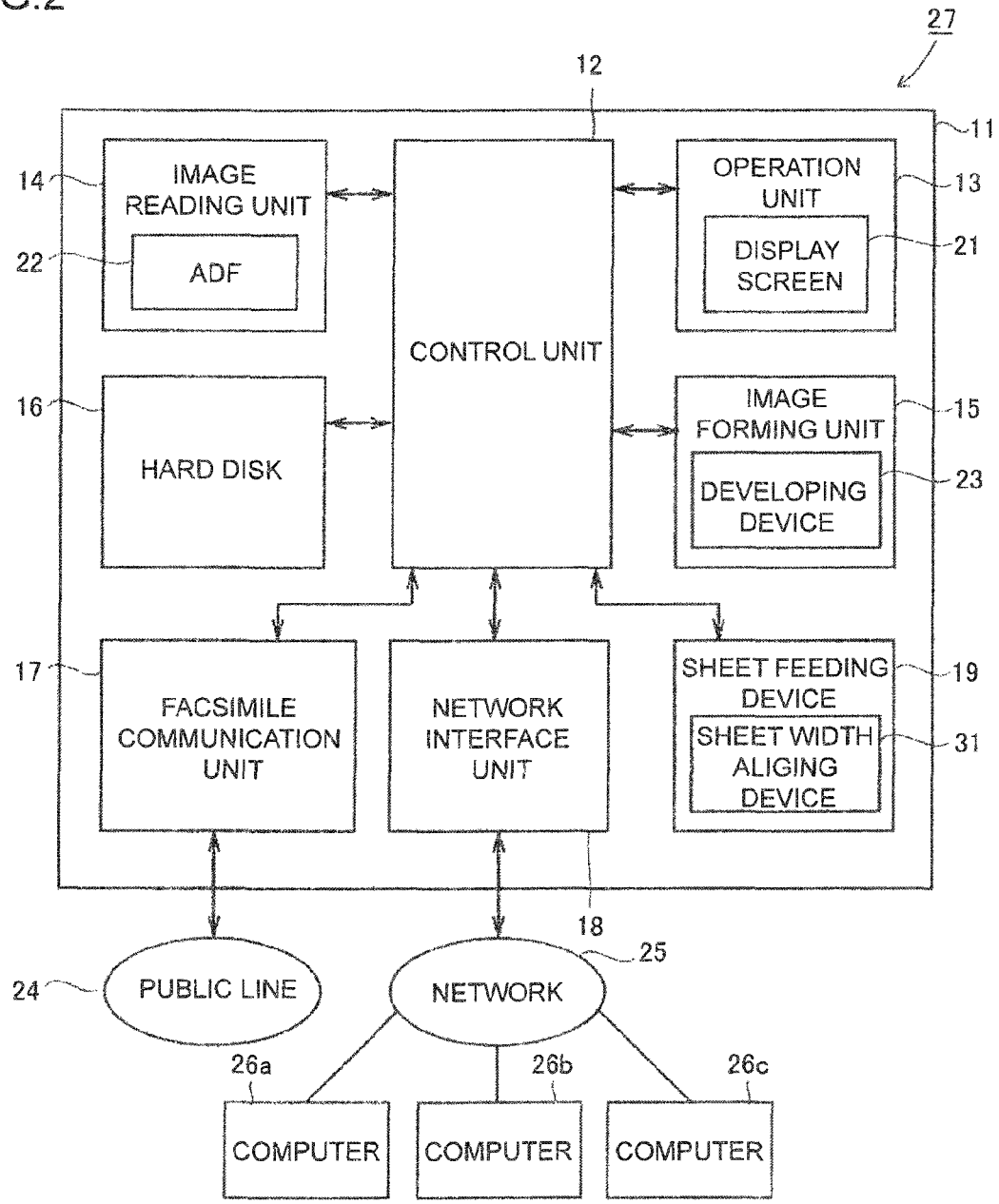
FIG. 2 is a block diagram showing the configuration of the digital multi-function peripheral equipped with the sheet feeding device including the sheet width aligning device according to the embodiment of the disclosure.

An embodiment of the present disclosure will be described below. First of all, description will be made about the configuration of a digital multi-function peripheral (hereinafter, sometimes simply referred to as "multi-function peripheral") equipped with a sheet feeding device including a sheet width aligning device according to the embodiment of the disclosure. FIG. 1 is a schematic perspective view showing the appearance of the multi-function peripheral equipped with the sheet feeding device including the sheet width aligning device according to the embodiment of the disclosure. FIG. 2 is a block diagram showing the configuration of the multi-function peripheral equipped with the sheet feeding device including the sheet width aligning device according to the embodiment of the disclosure.

Referring to FIGS. 1 and 2, a multi-function peripheral 11 includes a control unit 12, an operation unit 13, an image reading unit 14, an image forming unit 15, a hard disk 16, a facsimile communication unit 17, a network interface unit 18 used to connect with a network 25, and a sheet feeding device 19 that includes a manual feeder and feeds sheets of paper. The control unit 12 controls the entire multi-function peripheral 11. The operation unit 13 includes a display screen 21 that displays information submitted from the multi-function peripheral 11 and entries made by users. The operation unit 13 allows the users to input image forming conditions, such as the number of copies and gradation degrees, and to turn on or off the power source. The image reading unit 14 includes an auto document feeder (ADF) 22 that automatically feeds a document loaded thereon to the image reading unit 14. The image reading unit 14 reads images of the document. The image forming unit 15 includes a development device 23 that develops images with toner. The image forming unit 15 forms images based on read image data or image data transmitted via the network 25. The hard disk 16 stores the transmitted image data, the input image forming conditions, and so on. The facsimile communication unit 17 is connected to a public line 24 and performs facsimile transmission and reception. The arrows in FIG. 2 indicate control signal flows and data flows relating to control operations and images.

The multi-function peripheral 11 operates as a copier by causing the image forming unit 15 to form an image based on data of images of documents read by the image reading unit 14. In addition, the multi-function peripheral 11 operates as a printer by receiving image data transmitted via the network interface unit 18 from computers 26*a*, 26*b*, 26*c* connected to the network 25 and causing the image forming unit 15 to form images based on the image data and print it on paper. In other words, the image forming unit 15 operates as a printing unit for printing required images. Furthermore, the multi-function peripheral 11 operates as a facsimile by receiving image data transmitted from the public line 24 through the facsimile communication unit 17 and causing the image forming unit 15 to form images using the image data via the DRAM, or by transmitting image data of a document, read by the image reading unit 14, through the facsimile communication unit 17 to the public line 24. In short, the multi-function peripheral 11 has a plurality of functions relating to image processing, such as a copying function, a printer function, and a facsimile function. The multi-function peripheral 11 also has a function of minutely setting each of the functions.

The image processing system 27 includes the multi-function peripheral 11 configured as described above and the computers 26*a*, 26*b*, 26*c* connected to the multi-function peripheral 11 via the network 25. This embodiment shows three computers 26*a* to 26*c*. Each of the computers 26*a* to 26*c* can make a print request to the multi-function peripheral 11 via the network 25 to perform printing. The multi-function peripheral 11 may be connected to the computers 26*a* to 26*c* with wires, such as local area network (LAN) cables, or may be wirelessly connected. In addition, other digital multi-function peripherals and servers may be connected within the network 25.

Figure 3:
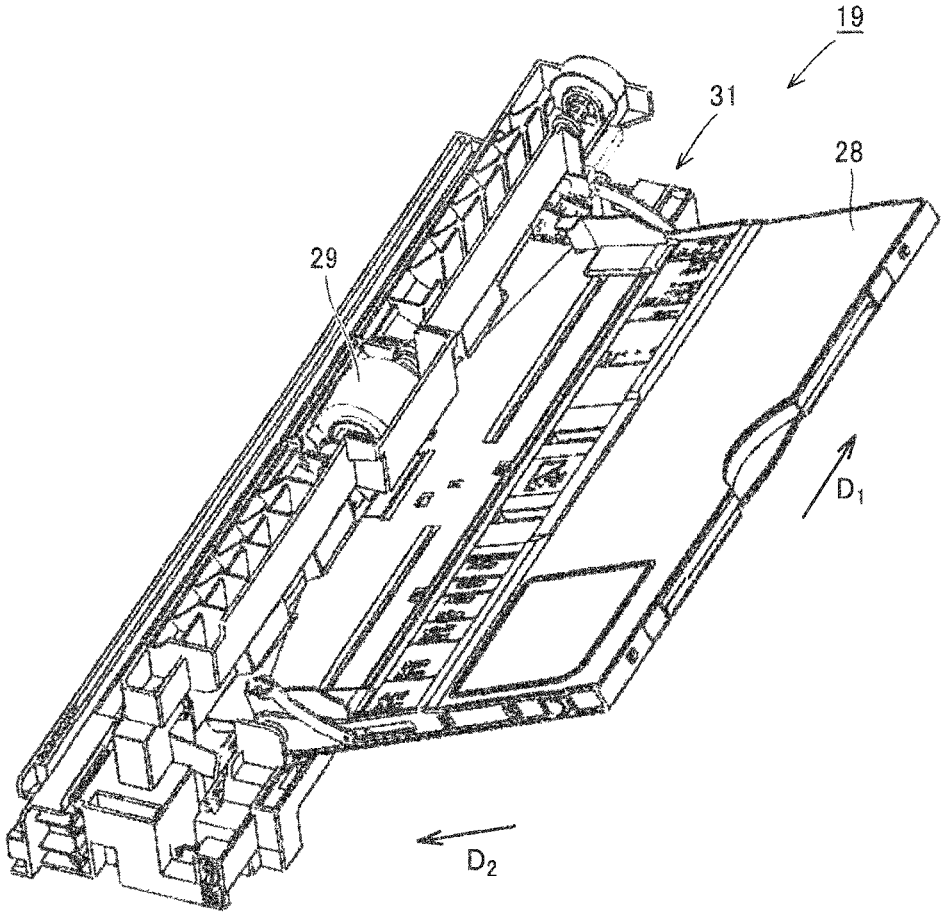
FIG. 3 is an external perspective view showing the configuration of the sheet feeding device.
Figure 4:
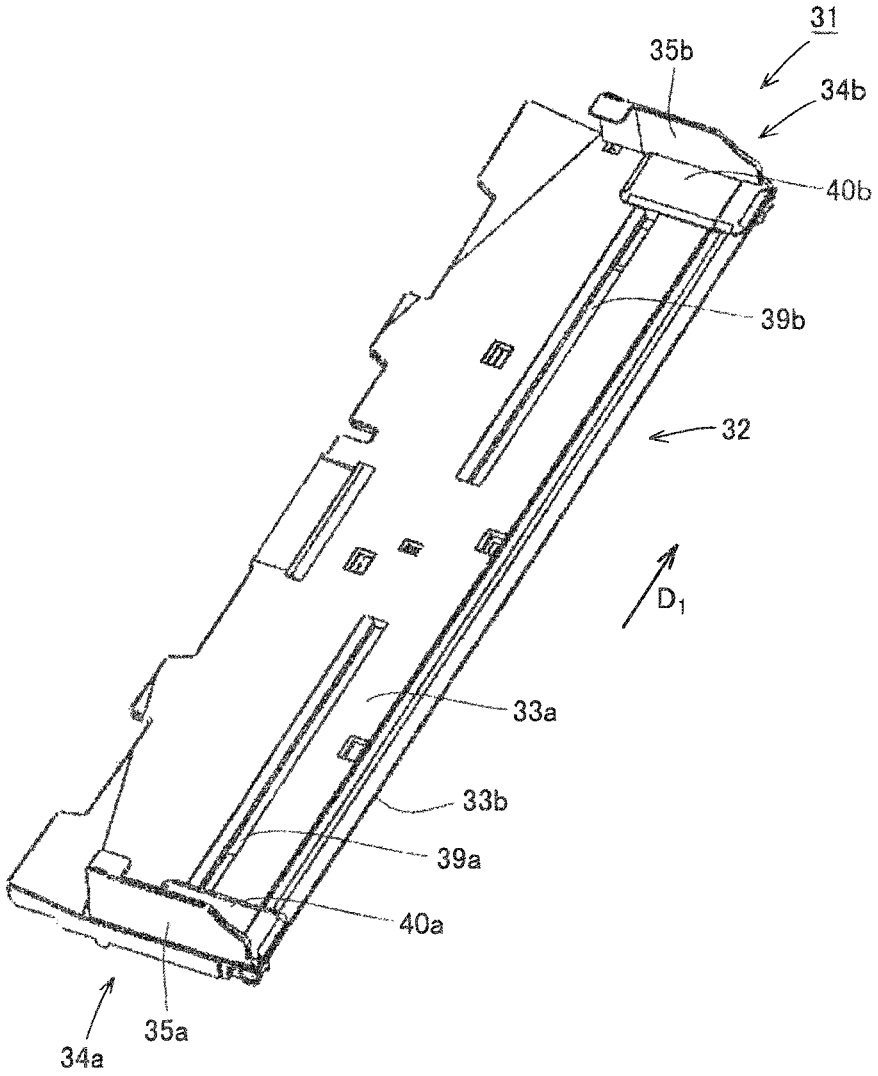
FIG. 4 is an external perspective view showing the configuration of the front face of the sheet width aligning device with a widely spaced pair of guides.
Figure 5:
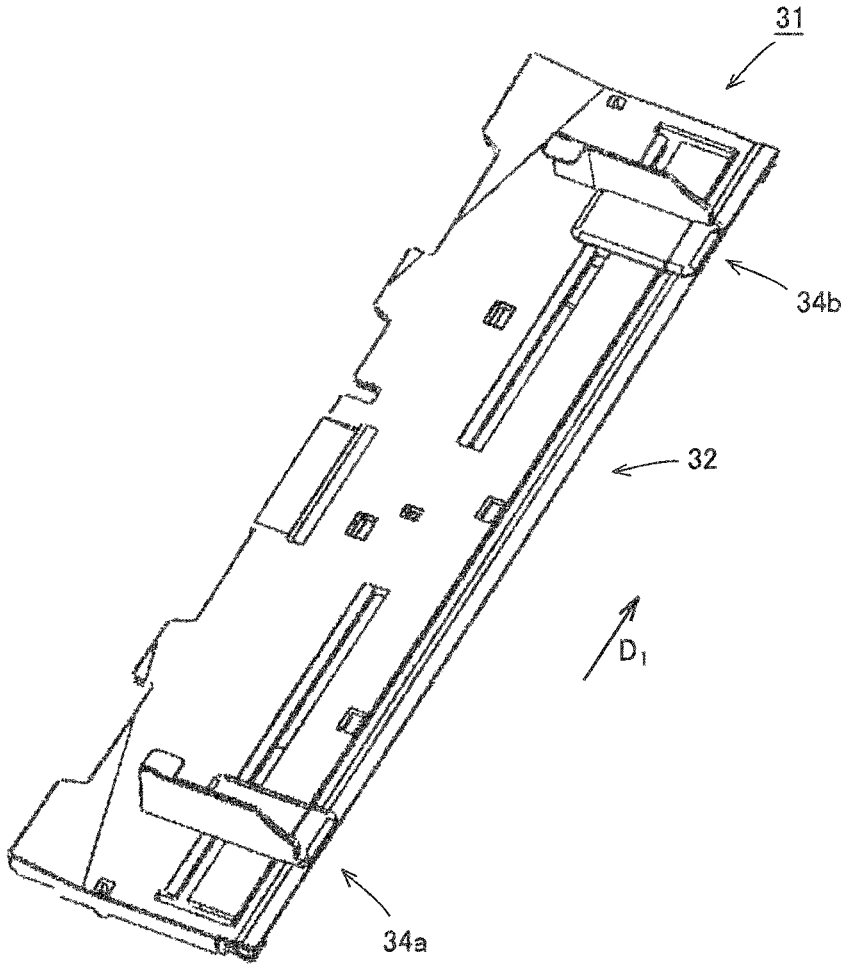
FIG. 5 is an external perspective view showing the configuration of the front face of the sheet width aligning device with a less widely spaced pair of guides.

Next, description will be made about the detailed configuration of the sheet feeding device 19 included in the multi-function peripheral 11, according to the embodiment of the disclosure. FIG. 3 is an external perspective view showing the configuration of the sheet feeding device 19. FIGS. 4 and 5 are external perspective views showing the configuration of the sheet width aligning device included in the sheet feeding device 19 shown in FIG. 3. FIG. 4 shows a pair of guides, which will be described later, arranged with a wide space therebetween. FIG. 5 shows the pair of guides arranged with a narrow space therebetween.

Referring to FIGS. 1 to 5, the sheet feeding device 19 serves as a manual feeder to feed sheets of paper loaded on an openable/closable manual feed tray, which is provided in a side face of the multi-function peripheral 11, into the multi-function peripheral 11. The sheet feeding device 19 is usually closed in the side face of the multi-function peripheral 11. If a user needs to manually feed a sheet to print on it, the user uses a handle (not shown) of the sheet feeding device 19 to pivotally open a sheet table, which will be described later, of the sheet feeding device 19 from the side of the digital multi-function peripheral 11. FIG. 3 shows the sheet feeding device 19 pulled out.

The sheet feeding device 19 includes a sheet table 28 on which sheets of paper are placed, a transport roller 29 that advances the sheets on the sheet table 28, and a sheet width aligning device 31 that is disposed on the sheet table 28 and is used to align the sheets on the sheet table 28 in the width direction. The sheet feeding device 19 feeds the sheets on the sheet table 28 to the image forming unit 15 disposed inside the multi-function peripheral 11. In the state shown in FIG. 3, the direction in which the sheets are carried is the direction indicated by Arrow D2 that is perpendicular to the direction indicated by Arrow $D_1$, which is the width direction of the sheets. Both the sheet table 28 and transport roller 29 make up a part of a sheet feeding mechanism included in the sheet feeding device 19. The sheet table 28 can accommodate, for example, a stack of a plurality of A4 sheets. The transport roller 29 sequentially transports the sheets on the sheet table 28 into the multi-function peripheral 11. Specifically, the sheets are advanced one by one to the image forming unit 15 that is disposed in the multi-function peripheral 11 and includes a photoreceptor (not shown), a development device 23 developing an image from an electrostatic latent image with toner, and a transfer section (not shown) transferring the toner image onto a sheet in order to transfer an image visualized by the toner. The transport roller 29 rotates with predetermined timing with power transmitted from a motor (not shown) provided in the multi-function peripheral 11 via a plurality of gears (not shown).

The sheet width aligning device 31 on the sheet table 28 aligns a plurality of sheets, which are loaded on the sheet table 28, in the width direction. Specifically, the sheets aligned in the width direction by the sheet width aligning device 31 are the same in size. The sheet width aligning device 31 can prevent image displacement in the width direction on the sheet during printing.

The sheet width aligning device 31 includes an elevator tray 32 that can accommodate sheets of paper thereon and can move up and down, and a pair of guides 34*a*, 34*b* that limit the movement of the sheets on the elevator tray 32 in the width direction. The sheet width aligning device 31 is disposed on the sheet table 28 provided in the sheet feeding device 19. A mechanism for aligning the width of the sheets is provided on the elevator tray 32. The sheets are placed on a placement surface 33*a*, which is a front face positioned at an upper side of the elevator tray 32. After sheets of paper are loaded, the sheet feeding device 19 lifts up the elevator tray 32 only at a predetermined angle in response to depression of a start key (not shown) provided on the operation unit 13. Lifting the elevator tray 32 brings the uppermost sheet on the elevator tray 32 into contact with the transport roller 29. Then, the transport roller 29 is rotated with predetermined timing. With the rotation of the transport roller 29, the loaded sheets are sequentially fed into the multi-function peripheral 11. After an image is formed on a sheet, or an image is printed on a sheet, the sheet is discharged outside the multi-function peripheral 11.

The elevator tray 32 has a pair of guide grooves 39*a*, 39*b* that guide the pair of guides 34*a*, 34*b*, respectively, to move in the width direction of the sheets. The pair of guides 34*a*, 34*b* can be manually moved along the guide grooves 39*a*, 39*b*, respectively, on the elevator tray 32 in the width direction of the sheets. The width direction of the sheets is indicated by Arrow $D_1$ shown in FIGS. 3 to 5, or the opposite direction. Specifically, a user slides the pair of guides 34*a*, 34*b* in the direction of Arrow $D_1$ or in the opposite direction to Arrow $D_1$ according to the widthwise dimension of the loaded sheets to determine the distance between the guides 34*a* and 34*b*. The distance between the guides 34*a* and 34*b* ranges from the maximum distance to the minimum distance to limit the movement of the sheets. For example, the minimum distance between the guides 34*a* and 34*b* corresponds to the width of a post card, which is the smallest available sheet of paper, while the maximum distance corresponds to the width of A3 paper, which is the largest available sheet of paper.

The guides 34*a*, 34*b* are formed by bending plate members in the vertical direction, respectively, and also are formed to be so-called L-shape in cross section, respectively. The guides 34*a*, 34*b* have thin plate-like base portions 40*a*, 40*b* formed in parallel with the elevator tray 32, and abutment portions 35*a*, 35*b* raised from the base portions 40*a*, 40*b*, respectively. The abutment portions 35*a*, 35*b* abut against sheet edges extending along the feed direction, respectively. The abutment portions 35*a*, 35*b* are formed as if they stand vertically on the placement surface 33*a*. The abutment portions 35*a*, 35*b* are oriented in parallel with the direction in which the sheets are advanced, and are opposed to each other in the width direction of the sheets. In the pair of guides 34*a*, 34*b*, the guide 34*a* is arranged on the front side of the multi-function peripheral 11, while the guide 34*b* is arranged on the rear side of the multi-function peripheral 11.

Figure 6:
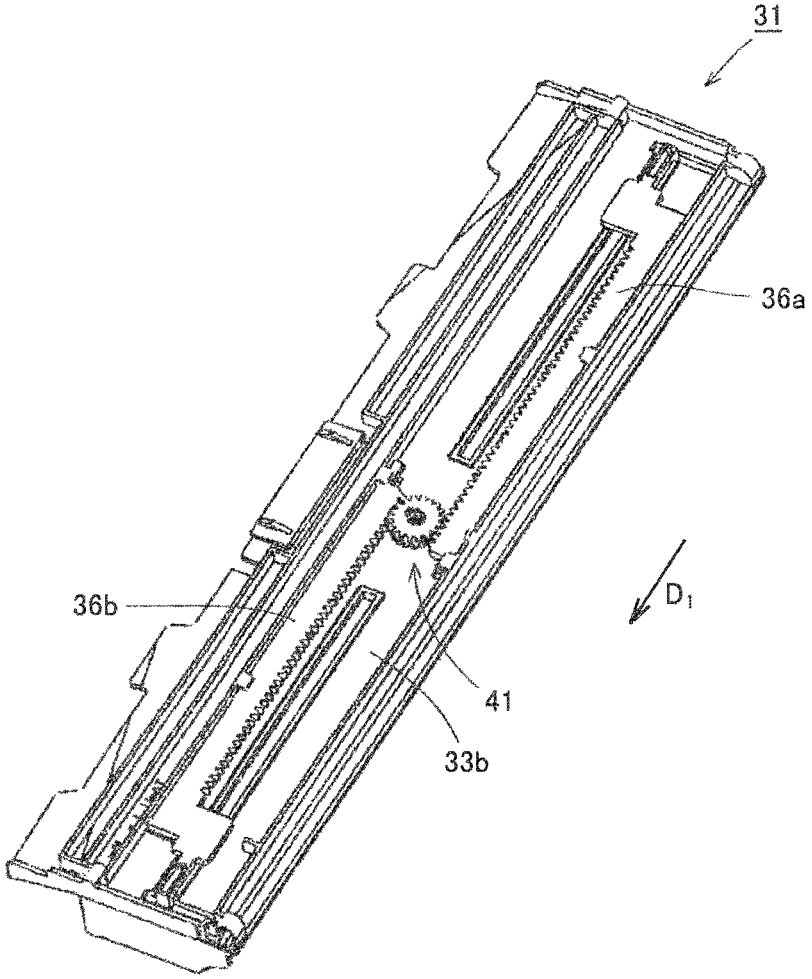
FIG. 6 is an external perspective view showing the configuration of the back face of the sheet width aligning device.
Figure 7:
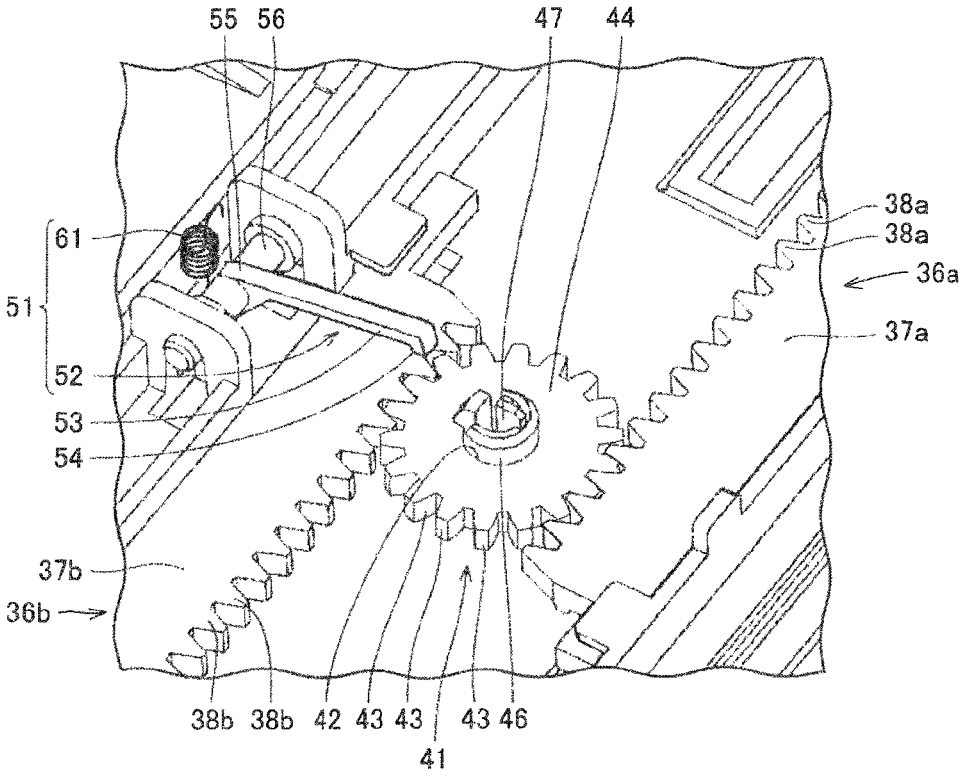
FIG. 7 is an enlarged perspective view showing main components on the back face of the sheet width aligning device in an enlarged scale.

FIG. 6 shows the sheet width aligning device 31 viewed from its back face side. FIG. 7 is an enlarged perspective view showing main components on the back face of the sheet width aligning device. FIG. 7 shows a pinion, which is shown in FIG. 6 and will be described later, and its surroundings on an enlarged scale. In order to provide a clear understanding, FIG. 6 omits a linking member and a spring hook, which will be described later. Referring to FIGS. 1 to 7, the sheet width aligning device 31 includes a pair of racks 36*a*, 36*b* that are operatively associated with the pair of guides 34*a*, 34*b*, respectively, so as to move in the width direction of the sheets, and a pinion 41 that rotates in mesh with the racks 36*a*, 36*b*. The racks 36*a*, 36*b* and pinion 41 are provided on a back face 33*b* of the elevator tray 32. The back face 33*b* is positioned opposite to the placement surface 33*a* where the sheets are placed.

The rack 36*a* is composed of a thin strip member 37*a*. The rack 36*a* has teeth 38*a* cut in one longitudinal side of the thin strip member 37*a* almost entirely from one end to the other. Similarly, the rack 36*b* is composed of a thin strip member 37*b* having teeth 38*b* cut in one longitudinal side of the thin strip member 37*b*. The teeth 38*a*, 38*b* are cut in a direction perpendicular to the direction in which the racks 36*a*, 36*b* move. Therefore, the teeth 38*a*, 38*b* are cut so as to be able to mesh with a spur gear.

The rack 36*a* is coupled with the base portion 40*a*, and in other words, the rack 36*a*, base portion 40*a*, and guide 34*a* are an integral component. The rack 36*b* is coupled with the base portion 40*b*, and in other words, the rack 36*b*, base portion 40*b*, and guide 34*b* are an integral component. The sheet width aligning device 31 includes a resin component integrally formed with the rack 36*a*, base portion 40*a*, and guide 34*a*, and is configured so that the guide 34*a* and base portion 40*a* are disposed on the placement surface 33*a* side, while the rack 36*a* is disposed on the back face 33*b* side which is opposite to the placement surface 33*a*. Similarly, the sheet width aligning device 31 includes a resin component integrally formed with the rack 36*b*, base portion 40*b*, and guide 34*b*, and is configured so that the guide 34*b* and base portion 40*b* are disposed on the placement surface 33*a* side, while the rack 36*b* is disposed on the back face 33*b* side which is opposite to the placement surface 33*a*. The rack 36*a* moves in the width direction of the sheets in operative association with the base portion 40*a* and guide 34*a*. Similarly, the rack 36*b* moves in the width direction of the sheets in operative association with the base portion 40*b* and guide 34*b*.

The pinion 41 is a so-called spur gear. That is, the teeth of the pinion 41 are cut in parallel with its rotational axis. The pinion 41 has a shaft hole 42 passing therethrough in the thickness direction at the center. An inner wall straightly extending through the pinion 41 in the thickness direction forms the shaft hole 42. The center of the shaft hole 42 is the center of rotation of the pinion 41. In addition, the pinion 41 has a circular recessed portion (not shown) between the teeth 43 formed on the radially outer edge and the shaft hole 42 in the radial direction. The circular recessed portion is recessed from one side toward the other side of the pinion 41 in the thickness direction. The pinion 41 is also made of resin.

The pinion 41 meshes with both the pair of racks 36*a*, 36*b*. The pinion 41 and the racks 36*a*, 36*b* are arranged so that the teeth 43 of the pinion 41 mesh with the teeth 38*a*, 38*b* of the racks 36*a*, 36*b*. The racks 36*a*, 36*b* move in opposite directions to each other with rotation of the pinion 41. Specifically, rotation of the pinion 41 increases or decreases the distance between the guides 34*a*, 34*b*, which are operatively associated with the racks 36*a*, 36*b*, respectively, in the width direction of the sheets.

The sheet width aligning device 31 includes a shaft portion 46 used to attach the pinion 41. The shaft portion 46 is formed on the back face 33*b* side of the elevator tray 32 so as to project from the back face 33*b*. In other words, the shaft portion 46 is provided on the elevator tray 32 so as to project toward the side where the pinion 41 is attached. The shaft portion 46 has a gap 47 therein. The shaft portion 46 is shaped almost like a circular truncated cone extending upward from the back face 33*b* of the placement surface 33*a* and being hollowed out in the center. An end part of the shaft portion 46 is partially cut out to form an engagement piece (snap-fit joint). The shaft portion 46 slips into the shaft hole 42 of the pinion 41 by bending the engagement piece having a claw on the tip to fit in the shaft hole 42 of the pinion 41. When the shaft portion 46 is inserted completely, the claw of the engagement piece engages with the edge of the shaft hole 42 to prevent the shaft portion 46 from slipping out from the shaft hole 42. Note that the top end of the shaft portion 46 is chamfered.

The sheet width aligning device 31 includes a pressing mechanism 51 that abuts against a lower surface 44, which is a face of the pinion 41 positioned on the lower side in the thickness direction, to pressing the pinion 41 in the thickness direction. Specifically, the pressing mechanism 51 in this embodiment includes a linking member 52 that serves as an abutment member being capable of abutting against the lower surface 44 of the pinion 41, and a spring hook 61 that serves as an elastic member causing the linking member 52 to press the pinion 41 by means of its elastic deformation.

Figure 8:
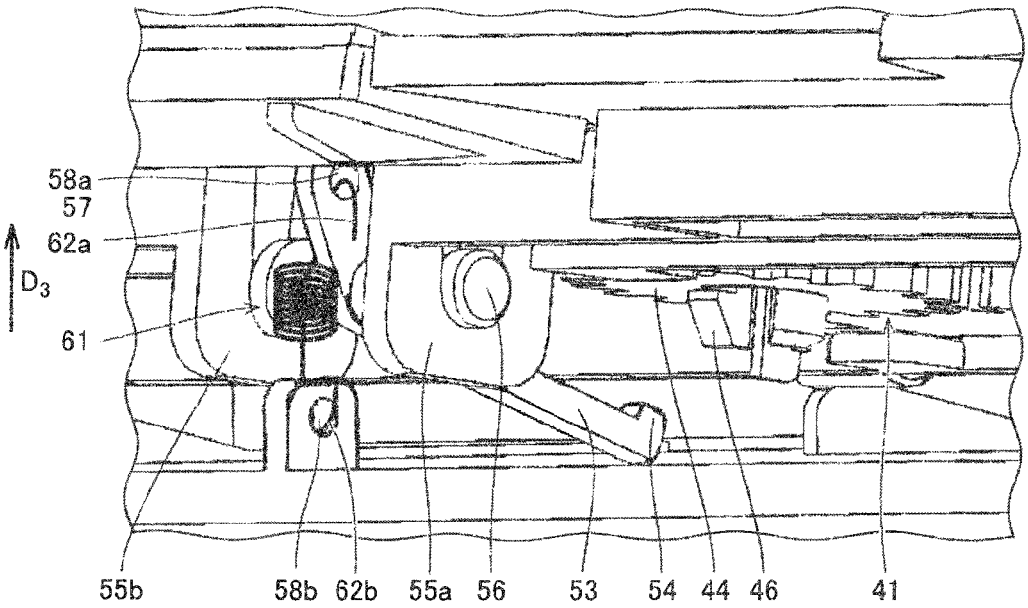
FIG. 8 is an external perspective view showing the configuration of the sheet width aligning device on the back face side when sheets of paper are loaded.

FIG. 8 is an external perspective view showing the configuration of the sheet width aligning device 31 on the back face side when sheets of paper are loaded. Referring to FIGS. 1 to 8, the linking member 52 is roughly composed of a stick-like arm portion 53 with an end bent vertically. The arm portion 53 is attached to a shaft portion 56, which is provided at a base end portion 55 of the arm portion 53, so as to pivot about the shaft portion 56 as a fulcrum. The shaft portion 56 is a round bar-like member provided on the back face side of the elevator tray 32 and extends in the direction in which the racks 36*a*, 36*b* extend. The shaft portion 56 is supported by a pair of wall portions 55*a*, 55*b*. The linking member 52 also includes a tip end 54 and an end 57 positioned opposite to the tip end 54 with respect to the shaft portion 56 as the center. In the end 57 formed is a first engagement hole 58*a* that is a through hole passing through the linking member 52 in the direction in which the shaft portion 56 extends. In other words, the linking member 52, or the abutment member, includes the first engagement hole 58*a*, serving as a first engagement portion, that is formed in an area extending from the shaft portion 56 in a different direction from the direction the arm portion 53 extends. In addition, a second engagement hole 58*b* is provided on the back face side of the elevator tray 32 so as to oppose to the first engagement hole 58*a*. More specifically, the second engagement hole 58*b*, serving as a second engagement portion, is provided on the sheet table 28 so as to face the first hole engagement 58*a*. The second engagement hole 58*b* is also a through hole extending in the direction in which the shaft portion 56 extends. The position of the first engagement hole 58*a* is moved up with upward movement of the elevator tray 32, while the position of the second engagement hole 58*b* is fixed regardless of the ascent and descent of the elevator tray 32. This means that the distance between the first engagement hole 58*a* and second engagement hole 58*b* increases with upward movement of the elevator tray 32.

The spring hook 61 is a coil spring hook, or more generally a tension/extension spring hook. The spring hook 61 has hook-shaped claws 62*a*, 62*b* on opposite ends. The claw 62*a* hooks on the first engagement hole 58*a*, and the claw 62*b* hooks on the second engagement hole 58*b*, thereby attaching the spring hook 61 to the first and second engagement holes 58*a*, 58*b*. The spring hook 61 in the state shown in FIG. 8 is not elastically deformed, but is attached at its free length. The linking member 52 pivots with an angular momentum produced by the weight of the arm portion 53 so that the tip end 54 of the linking member 52 moves away from the lower surface 44 of the pinion 41. Thus, the pressing mechanism 51 includes the spring hook 61, serving as a biasing member, that couples the first engagement hole 58*a* and second engagement hole 58*b*, and when the elevator tray 32 is in the upper position, biases the arm portion 53 to pivot about the shaft portion 56 as a fulcrum in the direction in which the arm portion 53 presses against the pinion 41.

Figure 9:
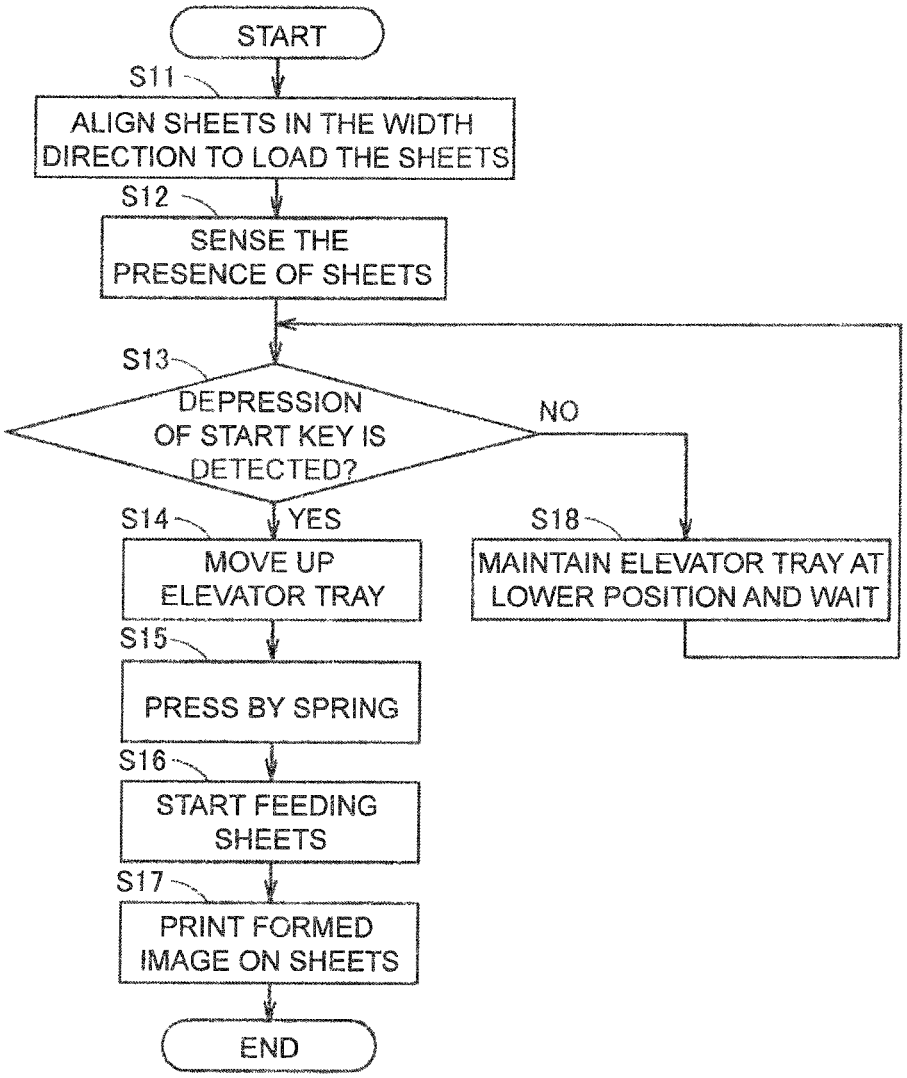
FIG. 9 is a flow chart for briefly describing an operating procedure to load sheets of paper and transport them.
Figure 10:
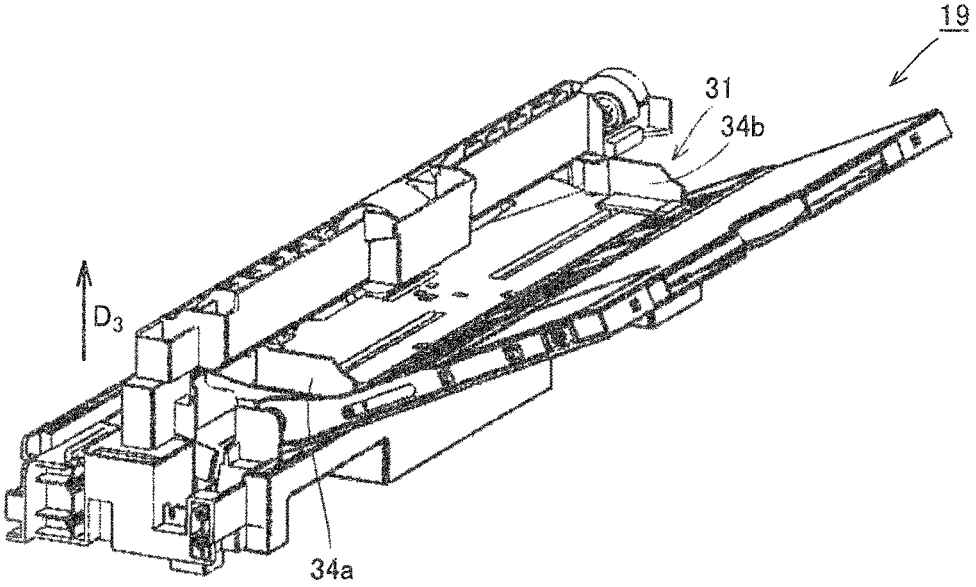
FIG. 10 is an external perspective view showing the configuration of the sheet width aligning device on the front face side when sheets of paper are transported.
Figure 11:
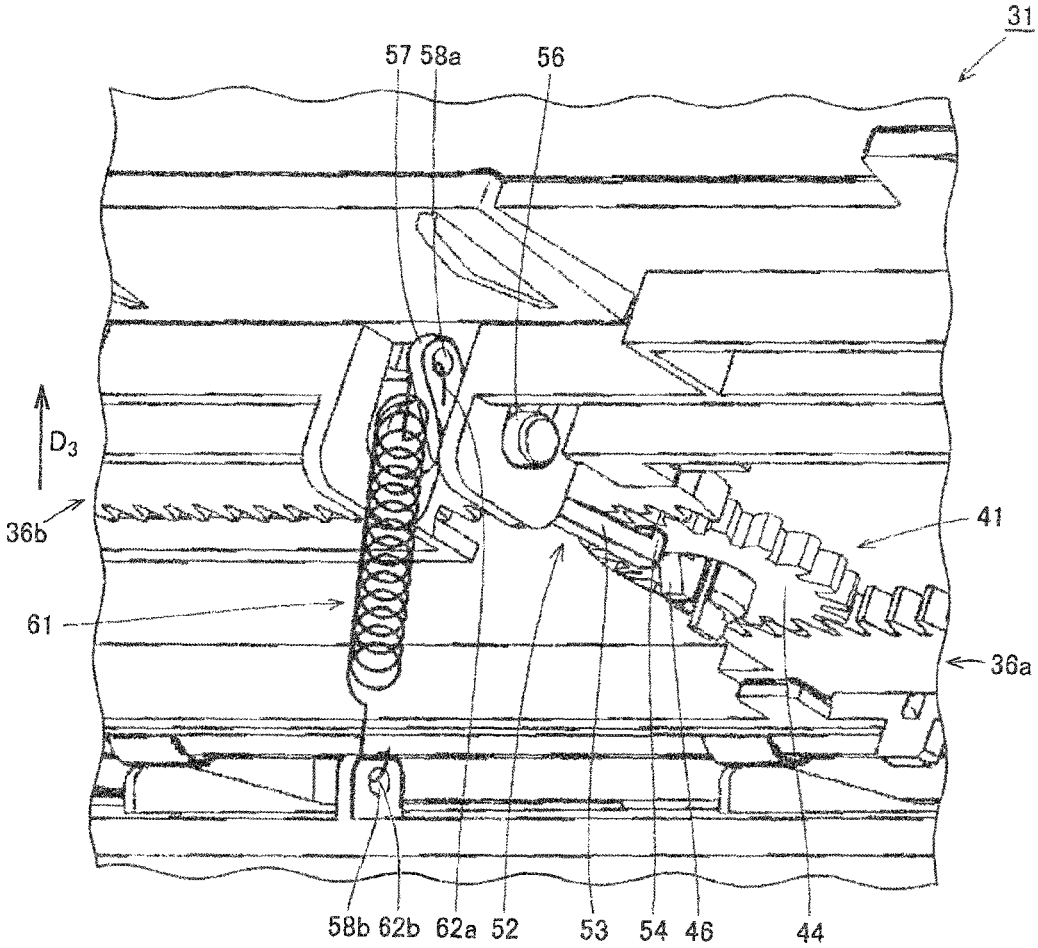
FIG. 11 is an external perspective view showing the configuration of the sheet width aligning device on the back face side when sheets of paper are transported.

FIG. 9 is a flow chart for briefly describing an operating procedure to load sheets of paper and transport them. FIG. 10 is an external perspective view showing the configuration of the sheet width aligning device 31 on the front face side when sheets of paper are transported. FIG. 11 is an external perspective view showing the configuration of the sheet width aligning device 31 on the back face side when sheets of paper are transported. Referring to FIGS. 1 to 11, an operating procedure to load sheets of paper and transport them will be described.

Referring to FIGS. 1 to 11, firstly, sheets of paper are loaded into the sheet feeding device 19. The sheets are aligned in the width direction by using the sheet width aligning device 31 and placed on the sheet table 28 (Step S11 in FIG. 10, hereinafter, "Step" is omitted). At this point, the elevator tray 32 is in a lower position.

In the lower position, as shown in FIG. 8, the spring hook 61 is at its free length, and the tip end 54 of the linking member 52 is not in contact with the pinion 41. Specifically, the pressing mechanism 51 is in an inactive state where the tip end 54 of the linking member 52 is not in contact with the lower surface 44 of the pinion 41 and therefore does not press against the pinion 41. The pinion 41 in this state is not put under the load of the linking member 52. Therefore, the load (sliding load) necessary to move the guides 34*a*, 34*b* with the pinion 41 meshed with the racks 36*a*, 36*b* remains small, thereby reducing the load to increase or decrease the distance between the guides 34*a*, 34*b*. Thus, a user can widen or narrow the space between the guides 34*a*, 34*b* with a light load.

Once the sheets are loaded, the presence of the sheets is sensed (S12). In this embodiment, the sheets are sensed by using an actuator (not shown), or other components, disposed near the transport roller 29. Then, it is detected whether the start key on the operation unit 13 has been depressed (S13).

If depression of the start key is detected (YES in S13), the sheets are transported. Specifically, the sheets loaded in the sheet feeding device 19 are fed one by one from the top into the multi-function peripheral 11. To feed the sheets, the control unit 12 brings the pressing mechanism 51 into operation.

Specifically, a forward end of the elevator tray 32 along the paper feeding direction is moved up (S14). In this step, a part of the elevator tray 32 on the side closer to the multi-function peripheral 11 is raised up by a predetermined amount so that the transport roller 29 abuts against the uppermost sheet on the elevator tray 32. The direction in which the elevator tray 32 is moved up is indicated by Arrow D3 in FIGS. 8, 10 and 11. The elevator tray 32 is moved up in the following manner. A compression spring hook and an eccentric cam, which are not shown in the drawings, are provided between the elevator tray 32 and sheet table 28. The eccentric cam is capable of rotating toward the multi-function peripheral 11. While the eccentric cam presses the forward end of the elevator tray 32, the elevator tray 32 is held at the lower position. During the sheet feeding, the eccentric cam is rotated to release the pressing. Then, the forward end of the elevator tray 32 moves upward to abut against the paper feeding roller. The elevator tray 32 is thus arranged at an upper position from the aforementioned lower position. In this manner, the control unit 12 operates the pressing mechanism 51.

Since the claw 62*a*, which is formed on one end of the spring hook 61, is engaged with the first engagement hole 58*a*, and the claw 62*b*, which is formed on the other end of the spring hook 61, is engaged with the second engagement hole 58*b*, the upward movement of the elevator tray 32 applies a force to the spring hook 61 in a direction in which the spring hook 61 extends. An elastic force of the spring hook 61, more specifically, a force that restores the tension/extension spring hook 61 to its natural length in the downward direction, which is the opposite direction to the direction indicated by Arrow D3, lifts the claw 62*a* of the spring hook 61 in the upward direction indicated by Arrow D3, by means of the principle of leverage using the shaft portion 56 as a fulcrum. Then, the tip end 54 of the linking member 52 having made contact with the lower surface 44 of the pinion 41 presses against the pinion 41 (S15). When the pinion 41 pressed by the linking member 52 rotates, sliding friction between the lower surface 44 of the pinion 41 and the tip end 54 of the linking member 52 increases.

At this point, the sheet feeding operation is started (S16). Since it is a large load to move the guides 34*a*, 34*b* with the pinion 41 meshed with the racks 36*a*, 36*b*, the possibility of increasing the distance between the guides 34*a*, 34*b* can be reduced. Consequently, the possibility of skewing the sheets during paper feeding can be also reduced. Subsequently, formed images are printed on the sheets (S17). Reduction of the possibility of skewing sheets can provide more appropriate printing. On the other hand, if depression of the start key is not detected (NO in S13), the elevator tray 32 remains awaiting at the lower position (S18) until the sheets are completely loaded.

According to the sheet width aligning device 31, when the sheets are loaded on the elevator tray 32 in the lower position, the linking member 52 included in the pressing mechanism 51 is separated from the pinion 41, thereby making the load small for the movement of the guides 34*a*, 34*b* with the pinion 41 meshed with the pair of racks 36*a*, 36*b*. Consequently, when a user loads sheets of paper on the elevator tray 32, the loads on the user to increase or decrease the distance between the guides 34*a*, 34*b* can be made small. On the other hand, when the sheets on the elevator tray 32 in the upper position are being advanced, the load to move the guides 34*a*, 34*b* with the pinion 41 meshed with the racks 36*a*, 36*b* is increased because the linking member 52 included in the pressing mechanism 51 presses against the pinion 41. This can reduce the possibility that the distance between the guides 34*a*, 34*b* may happen to increase. Thus, the sheet width aligning device 31 can provide excellent handleability and reduce the possibility of skewing sheets.

The sheet feeding device 19 also can provide excellent handleability and reduce the possibility of skewing sheets.

In this embodiment, since the pressing mechanism 51 includes the linking member 52 that serves as an abutment member capable of abutting against the lower surface 44 of the pinion 41, and the spring hook 61 that serves as an elastic member allowing the linking member 52 to press against the pinion 41 by means of the elastic deformation, the pressing mechanism 51 can appropriately abut the linking member 52 against the pinion 41 by means of the elastic deformation of the spring hook 61. In this embodiment, the spring hook 61, as an elastic member, biases the linking member 52 to press against the pinion 41 after the elevator tray 32 is placed at the upper position, and therefore the linking member 52 can be brought into proper contact with the pinion 41 by means of the elastic deformation of the spring hook 61.

The racks 36*a*, 36*b* are provided in a pair so as to move together with the pair of guides 34*a*, 34*b*, respectively, in the width direction of the sheets, and therefore, both the guides 34*a*, 34*b* can smoothly move in operative association with the racks 36*a*, 36*b*.

Although a spring hook is used as an elastic member in this embodiment, the present disclosure is not limited thereto, and can use another type of elastic member, for example, a rubber member. Alternatively, the present disclosure can dispense with any elastic member, but can be configured to enable or disable the operation of the pressing mechanism by using the control unit.

Although the shaft hole passes through the pinion in the thickness direction in this embodiment, the present disclosure is not limited thereto, and the shaft hole does not need to pass through the pinion in the thickness direction, alternatively, the shaft hole may be a recessed portion recessed in the pinion in the thickness direction.

Although the sheet width aligning device is applied to a manual sheet feeding device in this embodiment, the present disclosure is not limited thereto, and the sheet width aligning device can be applied to an ADF where an original document is loaded to automatically read. In addition, the sheet width aligning device may be provided in a paper feed cassette for accommodating a plurality of sheets to be printed in a digital multi-function peripheral.

Although the sheet feeding device is controlled by a control unit provided in the digital multi-function peripheral in this embodiment, the present disclosure is not limited thereto, and the sheet feeding device can be configured to be controlled by a standalone control unit provided to the sheet feeding device.

It should be understood that the embodiment and examples disclosed herein are illustrative and non-restrictive in every respect. The scope of the present disclosure is defined by the terms of the claims, rather than by the foregoing description, and is intended to include any modifications within the scope and meaning equivalent to the terms of the claims.

The sheet width aligning device and sheet feeding device according to the present disclosure are effectively used to meet demands for excellent handleability for users and reduction of the possibility of skewing.

What is claimed is:

1. A sheet width aligning device including an elevator tray that accommodates sheets of paper thereon and is capable of moving up and down between a lower position where the sheets are loaded and an upper position where the sheets are fed, a pair of guides that are provided on the elevator tray, are capable of moving in a width direction of the sheets, the width direction intersecting a feed direction in which the sheets are fed, and abut against sheet edges extending along the feed direction on the elevator tray to limit the movement of the sheets in the width direction, a pair of racks coupled with the pair of guides, respectively, and a pinion that is rotatably supported by inserting a shaft portion into a shaft hole formed in the pinion, the shaft portion projecting from the elevator tray, wherein the pair of guides are moved so as to increase or decrease the distance therebetween in operative association with the pair of racks meshed with the pinion, the sheet width aligning device comprising:

a pressing mechanism that is provided on a back face side of the elevator tray and includes an abutment member that abuts against the pinion, the pressing mechanism separating the abutment member away from the pinion when the elevator tray is in the lower position, and the pressing mechanism abutting the abutment member against the pinion to press the pinion when the elevator tray is in the upper position.

2. The sheet width aligning device according to claim 1, wherein the abutment member includes a shaft portion rotatably supported by a pair of wall portions provided on the back face side of the elevator tray and an arm portion extending from the shaft portion toward the pinion, the arm portion having a base end portion attached to the shaft portion so as to pivot about the shaft portion as a fulcrum, and when the elevator tray is in the upper position, a tip end of the arm portion abuts against a lower surface of the pinion.

3. The sheet width aligning device according to claim 2, wherein the abutment member includes a first engagement portion that is formed in an area extending from the shaft portion in a different direction from the direction the arm portion extends, a second engagement portion is provided on the sheet table so as to face the first engagement portion, and the pressing mechanism includes a biasing member that couples the first engagement portion and second engagement portion, and when the elevator tray is in the upper position, biases the arm portion to pivot about the shaft portion as a fulcrum in the direction in which the arm portion presses against the pinion.

4. The sheet width aligning device according to claim 3, wherein the biasing member includes a spring hook.

5. The sheet width aligning device according to claim 1, wherein when the elevator tray is in the lower position, the tip end of the arm portion is separated from the pinion.

6. A sheet feeding device including a sheet feeding mechanism that feeds sheets of paper, comprising:

a sheet width aligning device according to claim 1.

* * * * *